US005907740A

United States Patent [19]

Nozawa

[11] Patent Number: 5,907,740

[45] Date of Patent: May 25, 1999

[54] IMAGE FORMING APPARATUS HAVING PRE-TRANSFER CHARGE REMOVING MEANS

[75] Inventor: Taizo Nozawa, Kanagawa-ken, Japan

[73] Assignee: Kabushiki Kaisha Toshiba, Kawasaki, Japan

[21] Appl. No.: 08/923,457

[22] Filed: Sep. 4, 1997

[30] Foreign Application Priority Data

Sep. 12, 1996 [JP] Japan ..... 8-242089

[51] Int. Cl.[6] ..... G03G 15/00; G03G 15/16

[52] U.S. Cl. ..... 399/43; 399/44; 399/128; 399/296

[58] Field of Search ..... 399/38, 43, 44, 399/66, 127, 128, 296

[56] References Cited

U.S. PATENT DOCUMENTS

| | | | |
|---|---|---|---|
| 3,784,300 | 1/1974 | Hudson et al. | 399/296 |
| 4,348,098 | 9/1982 | Koizumi | 399/296 |
| 4,402,591 | 9/1983 | Nakahata | 399/296 |
| 4,468,113 | 8/1984 | Motohashi et al. | 399/45 |
| 4,482,240 | 11/1984 | Kuge et al. | 399/296 |
| 4,538,901 | 9/1985 | Soumiya | 399/128 |
| 5,029,314 | 7/1991 | Katsumi et al. | 399/44 |
| 5,333,037 | 7/1994 | Inoue et al. | 399/49 |
| 5,371,579 | 12/1994 | Bisaiji | 399/44 |

OTHER PUBLICATIONS

Patent Abstract of JP–61 159678, Jul. 19, 1986.
Patent Abstract of JP–06 282176, Oct. 7, 1994.
Patent Abstract of JP–61–027572, Feb. 7, 1986.
European Search Report.

*Primary Examiner*—William Royer
*Attorney, Agent, or Firm*—Foley & Lardner

[57] ABSTRACT

An image forming apparatus of the present invention includes a latent image forming unit to form an electrostatic latent image on a charged image carrier, a developing device to form a developer image by developing the electrostatic latent image formed on the image carrier by a developer and a charge removing unit to discharge the image carrier before transferring the developer image and reduce the electrostatic adsorbing power of the developer image to the image carrier. The charge removing unit includes a charge removing light source to apply the charge removing light to the image carrier and the developer image and the charge removing charger to remove the charge by discharging the image carrier and able to control the discharge output. The charge removing unit is controlled to be adjusted a charge removing capacity.

12 Claims, 10 Drawing Sheets

RELATIONSHIP BETWEEN PTL ON TIME AND PTL QUANTITY OF LIGHT BY LEFT TIME

DRUM LIFE NO. OF SHEETS (CONVERTED IN NO. OF REVOLUTIONS OF DRUM)

RELATIONSHIP BETWEEN DRUM LIFE & PTC OUTPUT

EFFECT OF THE PRESENT INVENTION FOR TRANSFER VOIDE

IMAGE FORMING APPARATUS HAVING PRE-TRANSFER CHARGE REMOVING MEANS

BACKGROUND OF THE INVENTION

1. Field of the Invention

The present invention relates to an image forming apparatus to form images according to an electrophotographic system such as a copying machine, printer, etc.

2. Description of the Related Art

Electrophotographic copying machines, printers, etc. are widely known as image forming apparatus. On electrophotographic copying machines, etc., after a photosensitive drum is uniformly charged by a main charger, an original document placed on a document table is exposed and by its reflected light is focused on the photosensitive drum, an electrostatic latent image is formed on the photosensitive drum. The electrostatic latent image on the photosensitive drum is developed by supplying toner particles from a developing device and a toner image is formed on the photosensitive drum. The formed toner image is transferred on a transfer paper that is charged by a transfer charger and a reproduced image is formed on this transfer paper.

On this kind of electrophotographic copying machines, copying speed has been increased in recent years. For the reasons of the increases in the diameter and peripheral speed of the photosensitive drum, etc. pursuant to the increase in the copying speed, the transfer efficiency of toner image electrostatically adhered on the photosensitive drum tends to become worse.

That is, when a toner image formed on the photosensitive drum is transferred on a transfer paper, if electrostatic adsorbing power of a toner to the photosensitive drum is too large, a toner image on the photosensitive drum is not sufficiently transferred on a transfer paper. As a result, defective images such as, for instance, a blurring of image on a transfer paper, insufficient image density, worse image minuteness, and transfer void are generated. These defects tend to increase pursuant to the increase in the copying speed.

In order to efficiently transfer a toner image electrostatically adhered to a photosensitive drum on a transfer paper, a charge removing means is often provided after developing an image and before transferring it. This pre-transfer charge removing means functions to weaken the electrostatic adhesive power between a toner and a photosensitive drum by removing the electric charge after developing and before transferring an image and efficiently transfer a toner on a transfer paper.

This pre-transfer charge removing means is broadly divided into two: a pre-transfer charge removing light source (PTL) to remove the electric charge on a photosensitive drum and a pre-transfer charger (PTC) to remove the electric charge on a photosensitive drum by the discharge from a wire, etc. and to improve the transfer efficiency of a toner itself.

The pre-transfer charge removing light source (PTL) is a means to weaken the electrostatic adhesive power of a toner to a photosensitive drum by removing the electric charge on a photosensitive drum by applying the light and a cold-cathode tube, LED, etc. are generally used. Further, with the increased speed of copying machines in recent years, it has become desirable to increase the transfer efficiency and for this purpose it is effective to increase the quantity of light of the pre-transfer charge removing light source. In many cases, a cold-cathode tube having a larger quantity of light than an LED is used for a pre-transfer charge removing light source.

The pre-transfer charger (PTC) is a means to weaken the electrostatic adhesive power between a photosensitive drum and a toner by discharging the photosensitive drum and charging the toner by a charger to facilitate the transfer of a toner image on a transfer paper. For this pre-transfer charger, a device to discharge DC charge of charged polarity and reverse polarity (that is the same polarity as a toner) of a photosensitive drum from a such very thin wire as platinum, tungsten oxide, etc. or a device to discharge AC charge after DC biased to the charged polarity and reverse polarity (that is, the same polarity of a toner) are used.

As described above, in case of electrophotographic copying machines, especially on copying machine with a photosensitive drum having increased speed for increasing a copying speed, a cold-cathode tube is often used as a pre-transfer charge removing light source to promote the toner image transfer efficiency in order to increase the transfer efficiency. However, when a cold-cathode tube is used as a pre-transfer charge removing light source, such problems as shown below are pointed out as characteristics of the cold-cathode tube.

That is, a large fluctuation of the quantity of light of a cold-cathode tube is pointed out. After a cold-cathode tube was continuously turned ON, that is, after the continuous copying by a copying machine, the cold-cathode tube was turned OFF and left for an hour and then turned ON, the quantity of light immediately after the cold-cathode tube is turned ON is low and gradually becomes clear.

Therefore, the quantity of light of a cold-cathode tube is set up so that the quantity of light when it is kept continuously turned ON prevents such defective images as transfer voids, etc. In this case, the quantity of light of the pre-transfer charge removing light becomes insufficient immediately after it is turned ON after left for an hour, the transfer efficiency may become worse and the transfer void can result. For this reason, after left for an hour, it is necessary to set the quantity of light of a cold-cathode tube immediately after it is turned ON at a sufficient quantity of light so as not to generate the transfer void. However, in this case the quantity of light of a cold-cathode tube when continuously kept ON becomes excessive and defects may be caused on an image such as image memory, etc. That is, when using a cold-cathode tube, the optimum width of quantity of light generating no image defects both immediately after and during when continuously kept ON is narrow (the margin of the quantity of light for transfer void and image memory is less).

Further, a cold-cathode tube has a characteristic that its quantity of light decreases under a low temperature environment, for instance, under environmental conditions of 5–10° C., 20 RH %. Therefore, when a cold-cathode tube is used under a low temperature environment, the quantity of light becomes insufficient and transfer void and other image defects are generated.

On the other hand, the pre-transfer charger discharges a photosensitive drum by discharging the reverse polarity for the charged polarity of a photosensitive drum. As this is equivalent to the same polarity charge as a toner, a toner of the image portion is charged to increase the transfer efficiency. However, some quantity of weakly charged toner adhered on a non-image portion (the white ground), so-called fog toner on a photosensitive drum, is also charged. This weakly charged toner is conveyed to a cleaning portion without being transferred if there is no pre-transfer charger, however, as it is easily transferred if charged by a pre-transfer charger, the fog on a transfer paper becomes very large. Thus, use of a pre-transfer charger may be troublesome in that the fog level becomes worse.

Defective images, such as fog caused by a pre-transfer charger occur most frequently when a photosensitive drum nears the end of its service life (due to increase of the white ground potential) or under humid conditions (due to decrease in developer charged amount).

SUMMARY OF THE INVENTION

It is an object of the present invention to provide an image forming apparatus capable of obtaining a good image without causing such image defects as transfer void, fog, etc. The present invention provides an image forming apparatus comprising means for electric charging uniformly an image carrier; means for forming an electrostatic latent image on the charged image carrier; means for developing the electrostatic latent image on the image carrier to form a developer image by using an electrostatic adsorbing power generating between a developer and the image carrier; means for transferring the developer image from the image carrier onto an image receiving medium; and means for removing the electric charge on the image carrier before transferring the developer image to reduce the electrostatic absorbing power; the charge removing means including a light source for applying a light to the image carrier and the developer image to reduce the electric charge; a charge removing charger for discharging onto the image carrier to remove the electric charge from the image carrier, the charge removing charger being controllable; and means for controlling the discharge output from the charge removing charger to adjust a charge removing capacity of the charge removing means.

DETAILED DESCRIPTION OF THE PREFERRED EMBODIMENTS

Hereinafter, embodiments of the present invention applied to an electrophotographic copying machine will be described in detail with reference to the attached drawings.

Figure 1:
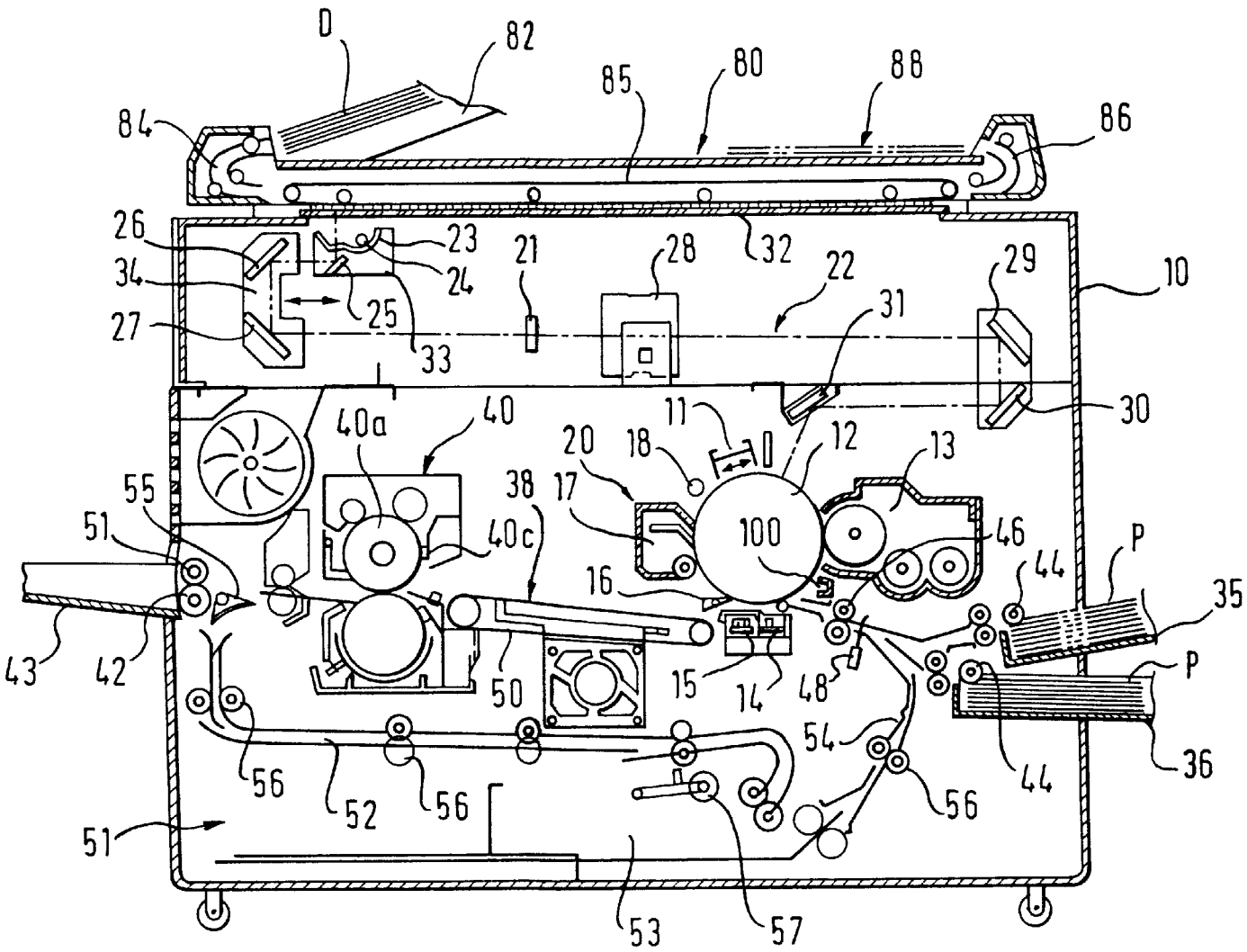
FIG. 1 is a sectional view showing the entire copying machine equipped with the pre-transfer charge removing means of the present invention.

First, the construction of the entire copying machine will be schematically described. As shown in FIG. 1, the copying machine is equipped with a housing 10 and as an image carrier, a photosensitive drum 12 made of arsenic selenium is provided rotatable approximately at the center in the housing 10. Around the photosensitive drum 12, a main charger 11, a developing device 13 which functions as a developing means, a transfer charger 14 which functions as a transferring means, a separation charger 15, a separation claw 16, a cleaning unit 17 and a charge removing lamp 18 are arranged in order, forming an image forming portion 20.

On the top of the housing 10, a document table 32 composed of a transparent glass and an automatic document feeder (hereinafter referred to as ADF) 80 to automatically feed an original document D on the document table 32 are provided.

The ADF 80 also has the function as a document retaining cover to open/close the document table 32. The ADF 80 is equipped with a document feeding tray 82 on which an original document D is placed and a document conveyor belt 85 which is arranged extending almost all over the document table 32. The original document D placed on the document feeding tray 82 is led on the document table 32 via a conveying path 84 and then, conveyed and located at the specified position by the document conveyor belt 85. Then, after being read by a scanner 22 which will be described later, the original document D is ejected in a discharged document receiver 88 on the top of the ADF 80 by way of a conveying path 86 by the document conveyor belt 85.

Under the document table 32 in the housing 10, there is provided the scanner 22 to read an image on the original document D placed on the document table 32. The scanner 22 is equipped with an exposure lamp 24 of which back is enclosed by a reflector 23 and a first mirror 25 which is placed on a first carriage 33 together with the exposure lamp 24. Further, the scanner 22 has a second and a third mirrors 26 and 27 which are placed on a second carriage 34 and movable jointly with it in one unit, a stationary lens 28, and fourth, fifth and sixth stationary mirrors 29, 30 and 31.

The first and second carriages 33 and 34 are moved along the document table 32 at a specified speed and scan the original document D by the light applied from the exposure lamp 24. Then, the reflected light from the original document D is led to the photosensitive drum 12 by the first through the sixth mirrors 25–27 and 29–31 and the lens 28 and exposes the surface of the photosensitive drum 12.

As described later, an electrostatic latent image corresponding to an image on the original document D is formed by the exposure on the surface of the photosensitive drum 12 which is uniformly charged by the main charger 11. The formed electrostatic latent image is developed by a toner that is supplied as a developer from the developing device 13 and a toner image is formed on the photosensitive drum 12. Thus, the main charger 11 and the scanner 22 compose a latent image forming means in the present invention.

Between the third mirror 27 and the lens 28, there is provided an automatic exposure sensor 21 to measure the quantity of exposure light. A part of the light reflected on the third mirror 27 enters in the automatic exposure sensor 21 which in turn outputs the output voltage corresponding to the image density as a document density signal to a CPU 62 which will be described later.

At the lower side of the housing 10, first and second paper supply cassettes 35 and 36 housing many paper P as transfer paper are mounted detachably. Further, in the housing 10, there is a paper conveying path 38 formed to convey paper P taken out of the first and the second paper supply cassettes 35 and 36 through a transfer portion positioned between the photosensitive drum 12 and the transfer charger 14. At the end of the paper conveying path 38, a fixing unit 40 is provided. On the side wall of the housing 10 opposing to the fixing unit 40, an exit port 42 is formed and a receiving tray 43 is mounted to the exit port 42.

The fixing unit 40 is composed of a heat roller 40*a* having a built-in heater, a pressure roller kept in contact with the heat roller 40*a* and a thermistor 40*c* to detect a temperature of the heated heat roller 40*a*.

Near the first and the second paper supply cassettes 35 and 36, a pick-up roller pair 44 is provided to take out paper P from respective paper supply cassettes. At the upstream side of the photosensitive drum 12 on the paper conveying path 38, there is provided an aligning roller 40 to align paper P and near the aligning roller 46, a sensor 48 is provided to detect the arrival of paper P.

Paper P taken out of the first paper supply cassette 35 or the second paper supply cassette 36 one by one by the pick-up roller 44 are conveyed to the transfer portion after being aligned by the aligning roller 46. Then, in the transfer portion, a toner image on the photosensitive drum 12 is transferred on the paper P by the transfer charger 14.

The paper P carrying the transferred toner image is separated from the photosensitive drum 12 by AC corona discharge from the separation charger 15 and the separation claw 16. The separated paper P is conveyed to the fixing unit 40 by way of a conveyor belt 50 which is composing the paper conveying path 38. Then, the paper P on which the toner image is melted and fixed is ejected on the receiving tray 43.

Under the paper conveying path 38, there is provided an automatic duplex unit 51 which leads the paper P passed through the fixing unit 40 to the transfer portion again by way of the aligning roller 46 after inverting it. The automatic duplex unit 51 is equipped with an inverting path to invert the paper P divided and conveyed by a gate flapper 55 which will be described later, a temporary stacker 53 to stack the inverted paper P temporarily and a re-conveying path 54 to convey the paper P from the temporary stacker 53 to the aligning roller 46.

Between the fixing unit 40 and an exit roller 51, the gate flapper 55 is provided to lead the paper P to the inverting path 52 and a plurality of conveying rollers 56 are arranged in the inverting path 52 and the re-conveying path 54. In the temporary stacker 53, a paper supply roller 57 is provided to take out the stacked paper P one by one and send to the re-conveying path 54.

When performing the duplex copying, paper P passed through the fixing unit 40 is led to the inverting path 52 by the gate flapper 55 and is stacked in the temporary stacker 53 after being inverted. The stacked paper P is taken out of the temporary stacker 53 and conveyed to the aligning roller 46 by way of the re-conveying path 54 by the paper supply roller 57. The paper P aligned by the aligning roller 46 is conveyed to the transfer portion again and a toner image is transferred on the back of the paper P in this transfer portion from the photosensitive drum 12. Thereafter, the paper P is ejected on the receiving tray 43 via the paper conveying path 38, the fixing unit 40 and the exit roller 51.

Figure 2:
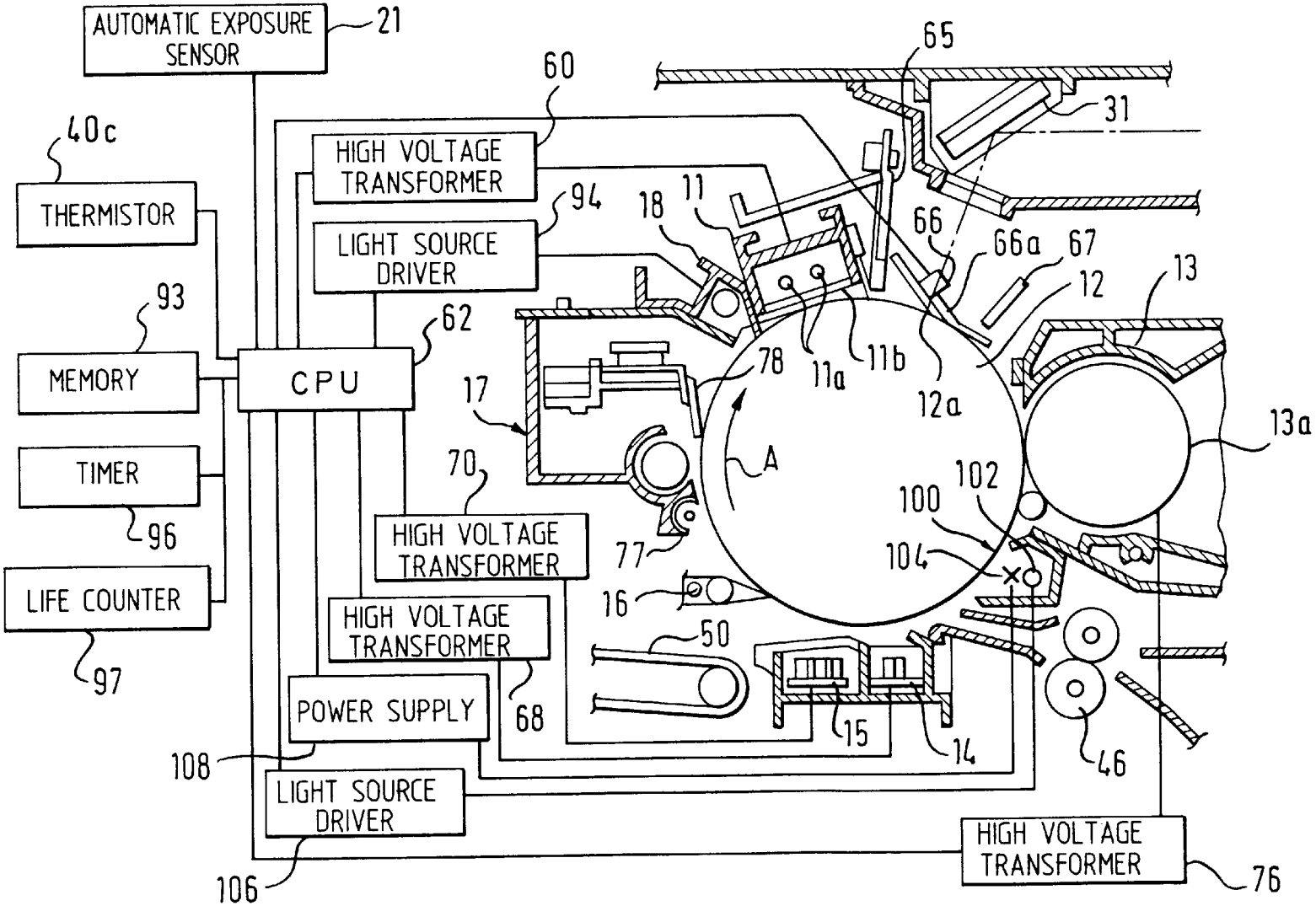
FIG. 2 is a diagram schematically showing the image forming portion and the control system of the copying machine shown in FIG. 1.

The construction of the photosensitive drum 12 and the image forming portion will be described in detail. As shown in FIG. 2, the main charger 11 which uniformly charges the surface of the photosensitive drum 12 to the specified potential has a corona wire 11*a* and a grid 11*b*. The corona wire 11*a* is connected with a power supply (not shown) which generates corona discharge by applying voltage. The grid 11*b* is connected with a high voltage transformer 60 which applies grid voltage. The power supply and the high voltage transformer 60 are connected to a CPU 62 which is a control means.

At the downstream side of the main charger 11 along the rotating direction of the photosensitive drum 12, there is an exposing position 12*a* on the surface of the photosensitive drum 12, which is exposed by the reflected light from the scanner 22. An electrostatic latent image is formed at this exposing position on the surface of the photosensitive drum 12.

Between the exposing position 12*a* and the main charger 11, an LED 65 is arranged to apply the light to erase the charged electric charge. That is, by this application of the light, no electrostatic latent image is formed on an unnecessary image portion. The developing device 13 has a developing roller 13*a* to develop an electrostatic latent image on the surface of the photosensitive drum 12 by supplying toner particles. To the developing roller 13*a*, a developing bias is applied by a high voltage transformer 76 under the control of the CPU 62.

Between the developing device 13 and the LED 65, there is provided a thermistor 66 which functions as a temperature detecting means to detect a temperature of the surface of the photosensitive drum 12. An actuator 66*a* of the thermistor 66 is kept in contact with the end of the photosensitive drum 12, that is, the surface of the drum at the outside of the image forming area. The thermistor 66 outputs a detection signal to the CPU 62.

Further, between the developing device 13 and the LED 65, a surface potential sensor 67 is provided to detect the surface potential of the photosensitive drum 12.

The transfer charger 14 which transfers a toner image formed on the photosensitive drum 12 on a paper P and the separation charger 15 for separating a paper P from the photosensitive drum 12 are provided at the downstream side of the developing device 13 in relation to the rotating direction A of the photosensitive drum 12. The transfer charger 14 and the separation charger 15 are formed in one united body and connected to the CPU 62 via high voltage transformers 68 and 70.

Between the developing device 13 and the transfer charger 14, a pre-transfer charge eliminator 100 is provided. The pre-transfer charge eliminator 100 is to remove the charge on the surface of the photosensitive drum 12 and reduce the electrostatic adhering force of a toner image to the surface of the photosensitive drum 12 and functions as a pre-transfer charge removing means.

The pre-transfer charge eliminator 100 is in a structure to jointly use a cold-cathode tube 102 as a pre-transfer charge removing lamp to apply the charge removing light to the photosensitive drum 12 and a pre-transfer charger 104.

The cold-cathode tube 102 is provided along the axial direction of the photosensitive drum 12 and is connected to the CPU 62 via a light source driver 106. The pre-transfer charger 104 uses a platinum clad wire (ø65 $\mu$m) extending along the axial direction of the photosensitive drum 12 and is connected to the CPU 62 via a power supply 108.

The discharge output, that is, the charge removing capacity of the pre-transfer charger 104 can be varied according to applied voltage. As described later, under the control of the CPU 62, the discharge output is adjusted according to change in the quantity light of the cold-cathode tube 102, change in humidity and the usage history of the photosensitive drum 12 and the charge removing capacity of the entire pre-transfer charge eliminator 100 is maintained at a specified value.

At the downstream side of the separation charger 15, the separation claw 16 is provided and in addition, at the downstream side of the separation claw 16, the cleaning unit 17 having a cleaning blade 78 is provided. The cleaning blade 78 is provided in contact with the surface of the photosensitive drum 12 and scrapes off toner that was not transferred and left on the surface of the photosensitive drum 12 therefrom.

Between the separation claw 16 and the cleaning unit 17, a charger 77 equipped with a corona wire for applying AC voltage to the photosensitive drum 12 is provided as an auxiliary cleaning mechanism.

Between the cleaning unit 17 and the main charger 11, a charge removing lamp 18 is provided. This charge removing lamp 18 is connected to the CPU 62 via a light source driver 94. The quantity of light of the charge removing lamp 18 is variable by changing the voltage applied to the light source driver 94 under the control of the CPU 62.

The CPU 62 is connected with a timer 96, the thermistor 40*c*, a life counter 97 and a memory 93. The timer 96 measures a working time and a pause time of the copying machine, that is, a time from when the copying operation was once terminated to the next copying operation is started. The thermistor 40*c* detects a temperature of the heat roller 40*a* of the fixing unit 40. The life counter 97 counts the usage times of the photosensitive drum 12. The memory 93 stores various control data.

The timer 96 functions as a time detecting means in the present invention to detect a pause time and a continuous ON time. The thermistor 40*c* also functions as a means to detect a pause time based on a temperature of the heat roller 40*a*. Further, the thermistor 66 functions as a temperature detecting means to detect an environmental temperature according to a temperature of the photosensitive drum 12. The life counter 97 functions as a detecting means for detecting a usage history of the photosensitive drum 12.

On a copying machine constructed as described above, the pre-transfer charge eliminator 100 controls the discharge output according to change in the quantity of light of the cold-cathode tube 102, change in the environment, the usage history of the photosensitive drum 12, etc. By this control, the desired charge removing capacity is maintained and such defects as transfer void, generation of an image memory, fog, etc. are prevented.

The relationship between the quantity of light of the cold-cathode tube 102 and the discharge output of the pre-transfer charger 104 will be described. The quantity of light of the cold-cathode tube 102 changes according to its pause time or an environmental temperature.

Figure 3:
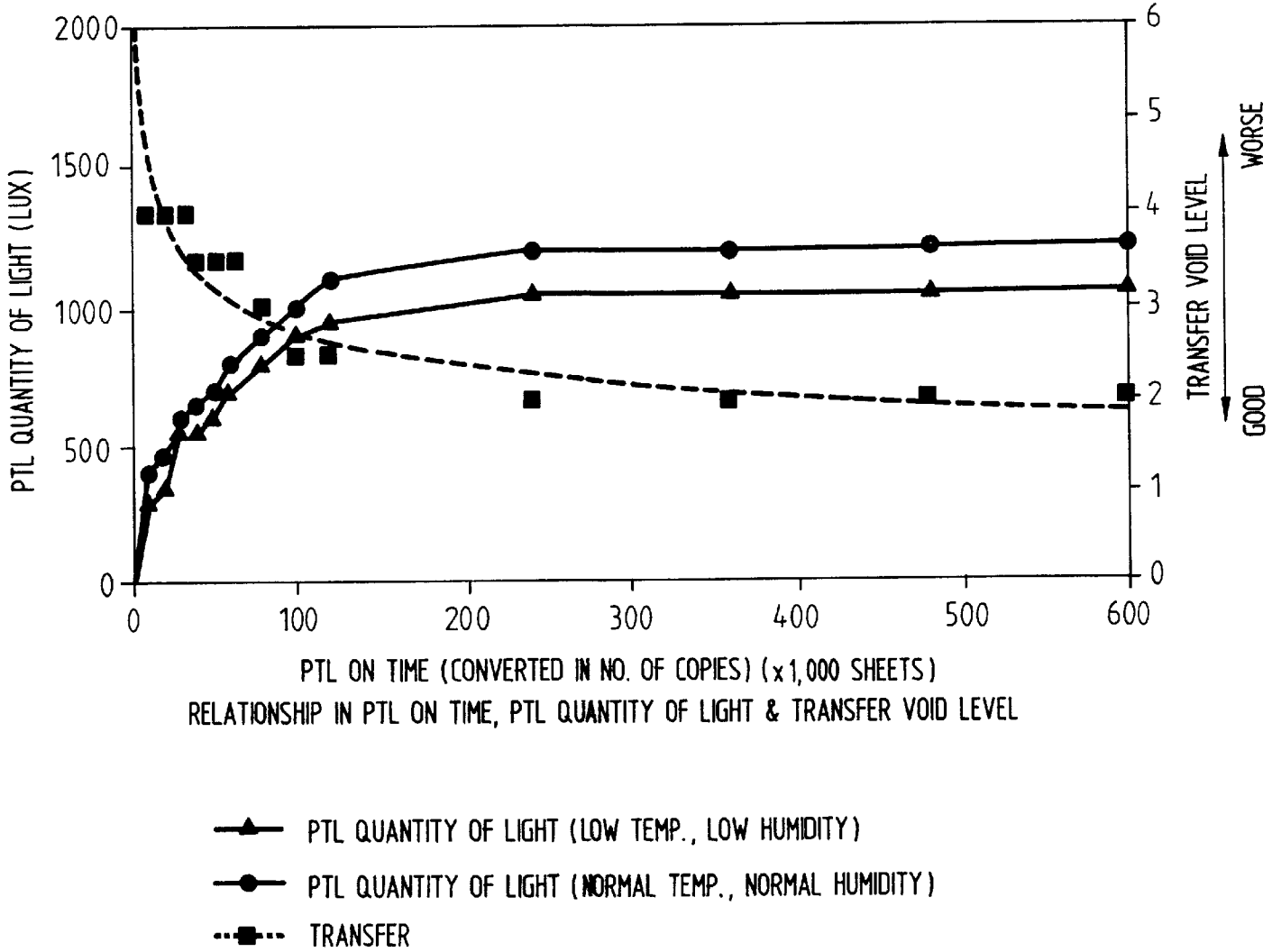
FIG. 3 is a graph showing the relationship among the lighting time of the cold-cathode tube, quantity of light and transfer void level.

FIG. 3 shows changes in the quantity of light and the transfer void levels when the cold-cathode tube 102 of the pre-transfer charge eliminator 100 is turned ON after the copying machine was left for 60 min., that is, after paused for 60 min. at a normal temperature environment (temperature 23° C., humidity 50%) and a low temperature environment (10° C., 20%).

In FIG. 3, the axis of abscissas shows the number of continuously copy sheets corresponding to the continuous ON time of the cold-cathode tube 102 and the first axis of ordinates shows the quantity of light of the cold-cathode tube 102 and the second axis of ordinates shows the transfer void level, respectively.

The copying machine used for the review was Toshiba Analog PP-CF154 (65CPM machine), the developer was D-1710, the toner was T-2510 and the photosensitive drum was an OPC drum in ø100. For evaluating the transfer void, LT size paper of Hammer Mill Tidal-DP was used. Further, for the cold-cathode tube 102, a product of which maximum illuminance becomes 1200 lux at a normal temperature environment was used. For an illumination meter for measuring the quantity of light, MINOLTA T-IM was used and the intensity of illumination was measured by mounting a 3×10 mm slit to the probe of the illumination meter.

As clearly seen in FIG. 3, when a copying machine was operated after left for a long time in a normal temperature environment, that is, when the cold-cathode tube 102 was turned ON, the cold-cathode tube was dark immediately after it was turned ON but the quantity of light did not reach the maximum output therefrom for several seconds through several ten seconds and thereafter, becomes gradually bright. There are many transfer voids until the quantity of light of the cold-cathode tube 102 increases to about 1000 lux and transfer voids become less gradually with the increase of the quantity of light. The same inclination is observed in a low temperature environment and the quantity of light of the cold-cathode tube 102 becomes generally lower than the normal temperature environment.

Figure 4:
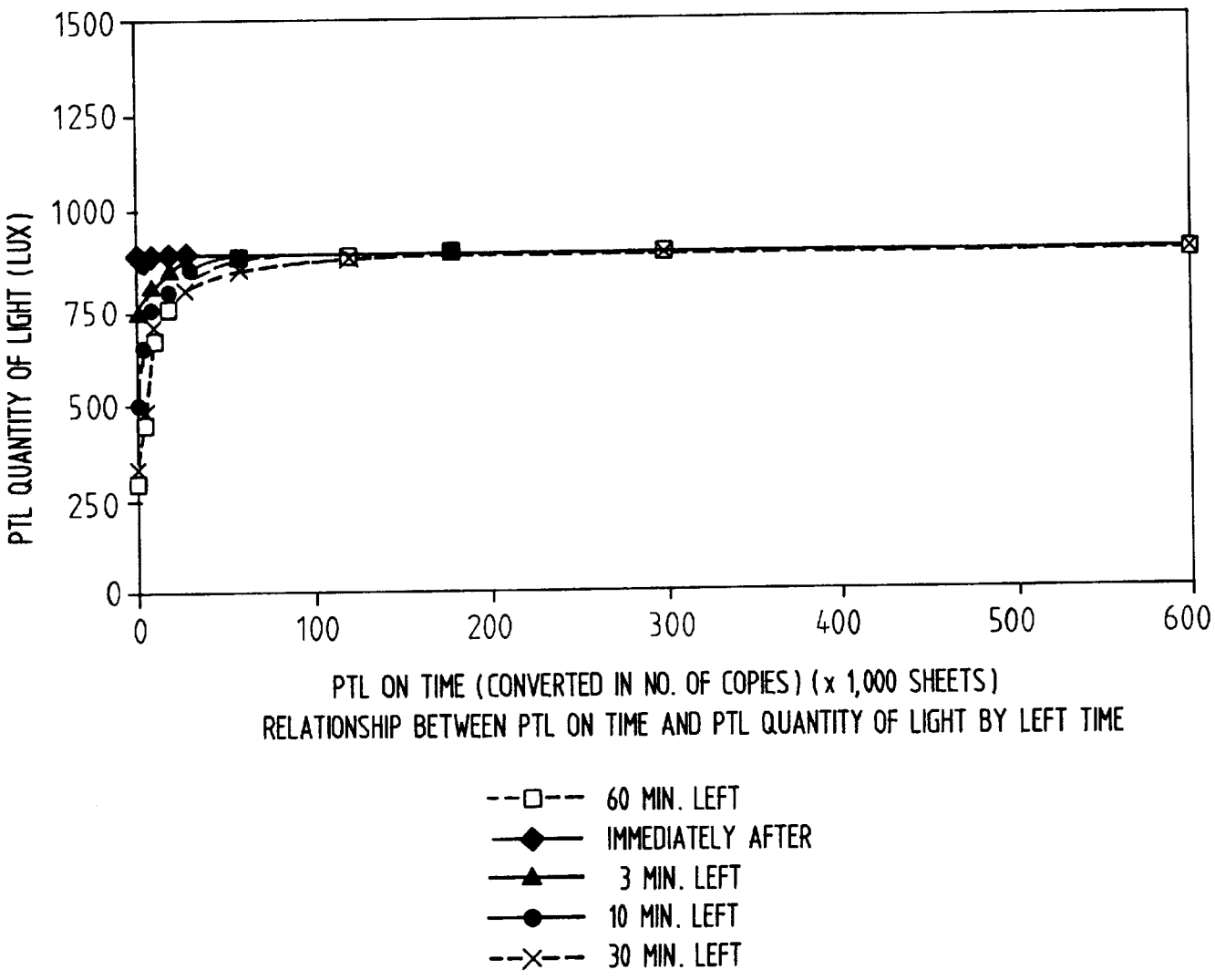
FIG. 4 is a graph showing the relationship between the lighting time and the quantity of light of the cold-cathode tube at different pause times.

The quantity of light of the cold-cathode tube 102 immediately after it was turned ON depends on a pause time of the copying machine, that is, a pause time of the cold-cathode tube 102. FIG. 4 shows changes in the quantity of light of the cold-cathode tube 102 when it was continuously turned ON after paused when the pause time of the cold-cathode tube 102 was changed variously. For a copying machine and an illumination meter used in this test, the same items shown in FIG. 3 were used and the tests were conducted under the same conditions.

In FIG. 4, the axis of abscissas shows the time of the cold-cathode tube 102 continuously turned ON and the axis of ordinates shows the progress of the quantity of light of the cold-cathode tube 102. As clearly seen in this figure, according to differences in times when the cold-cathode tube 102 was left, the rising of the quantity of light of the cold-cathode tube when continuously turned ON changes and the less the left time is short, the quantity of light immediately after turn ON is near the maximum quantity of light and the more the left time is longer, the quantity of light starts from a low level.

According to this embodiment, the CPU 62 as a control means supplements the insufficient quantity of light of the cold-cathode tube 102 immediately after starting the copying by increasing the discharge output of the pre-transfer charger 104 immediately after starting the copying and thereby, setting the charge removing capacity of the entire pre-transfer charge eliminator 100 at a specified level generating no transfer void.

The discharge output of the pre-transfer charger 104 is adjustable by controlling voltage applied from the power supply 108. The discharge output of the pre-transfer charger 104 is controlled contrary to the progress of the quantity of light of the cold-cathode tube 102. That is, the applied voltage is so controlled that the discharge output of the pre-transfer charger becomes maximum immediately after turning the cold-cathode tube 102 ON and decreases the discharge output gradually with the increase of the quantity of light of the cold-cathode tube. Thus, the charge eliminating capacity of the pre-transfer charge eliminator 100 is kept nearly at a specified value.

Figure 5:
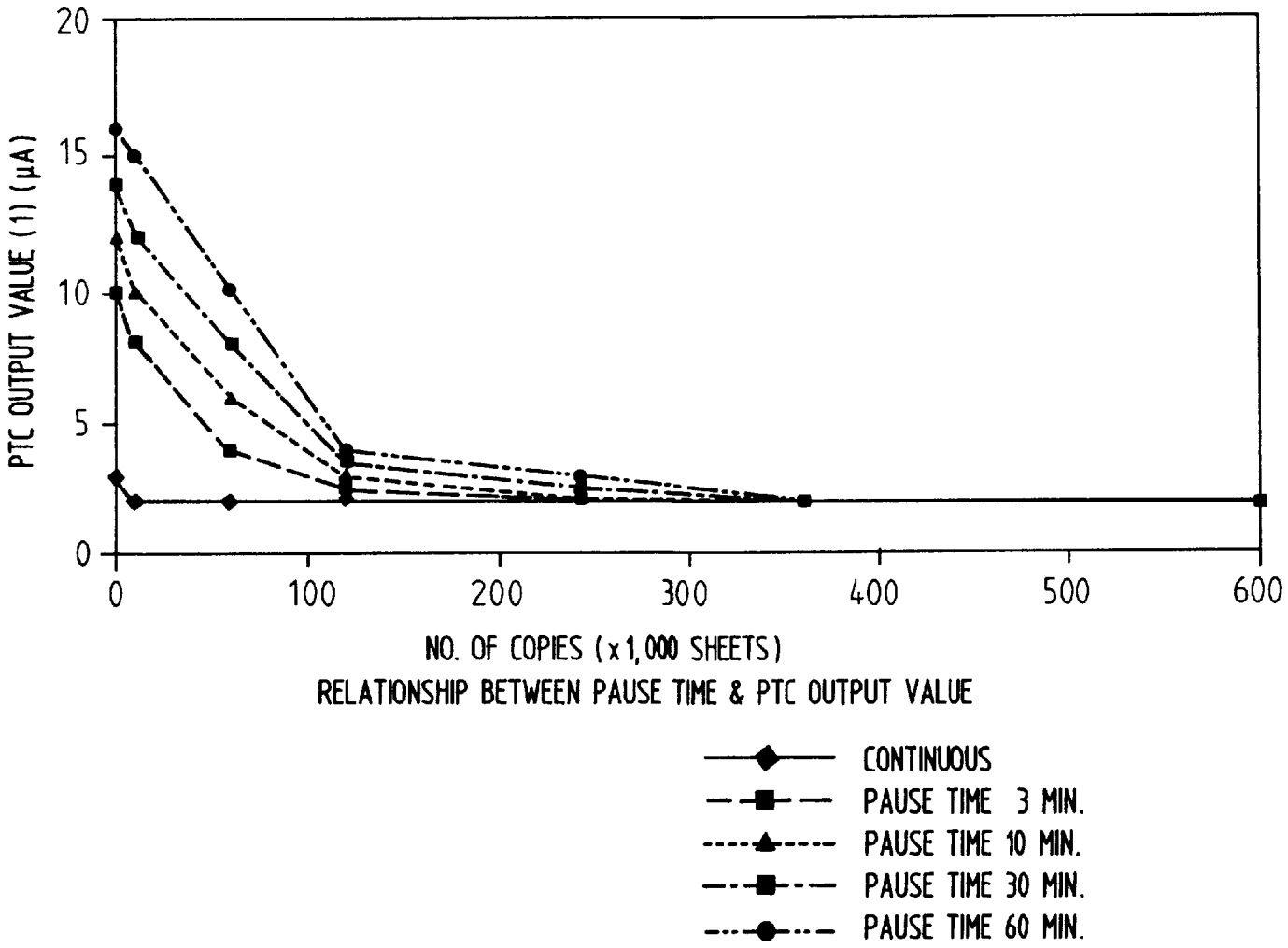
FIG. 5 is a graph showing the output values of the pre-transfer charger controlled according to the pause times of the cold-cathode tube.

A discharge output value, that is, an initial value of the pre-transfer charger 104 immediately after the cold-cathode tube 102 is turned ON is set up according to a pause time of the copying machine as shown in FIG. 5. In other words, the more a pause time is longer, the higher an initial output value of the pre-transfer charger 104 is set up. Then, after the cold-cathode tube 102 is turned ON, the discharge output is gradually decreased and after the cold-cathode tube 102 reached the maximum quantity of light, the discharge output is maintained at a constant value.

For instance, when a cold-cathode tube of which the maximum quantity of light is within the range of 500–2000 lux, the discharge output of the pre-transfer charger 104 is decreased gradually in the range of 1–20 $\mu$A for the period from the start of copying to 120 seconds according to a left time of the cold-cathode tube.

As a result, a total charge removing capacity of the cold-cathode tube 102 and the pre-transfer charger 104, that is, the charge removing capacity of the pre-transfer charge eliminator 100 can be maintained nearly constant irrespective of a pause time of the copying machine.

As the quantity of light of the cold-cathode tube 102 in a low temperature environment decreases generally lower than in a normal temperature environment as described above, it is necessary to increase the discharge output of the pre-transfer charger 104 higher than in a normal temperature environment. On the contrary, in a high temperature and humid environment (for instance, temperature 30° C., humidity 85%), the charged quantity of a developer decreases and fog on the photosensitive drum increase. If the photosensitive drum is excessively charged by the pre-transfer charger 104 under this state, toner on the white ground is strongly charged and wholly drawn on a transfer paper, generating a white ground fog thereon although the toner should pass the transfer position originally because of its weak charge and recovered by the cleaning unit 17. Therefore, in case of the high temperature and humid environment, it is necessary to reduce the charge output of the pre-transfer charger 104.

According to this embodiment, in a low temperature environment, the discharge output of the pre-transfer charger 104 is so controlled that it is increased higher than that in a normal temperature environment and on the contrary, it is decreased in a high temperature and humid environment. For instance, the discharge output of the pre-transfer charger 104 is variable in a range of 1–20 $\mu$A according to the detected environmental temperature.

Figure 6:
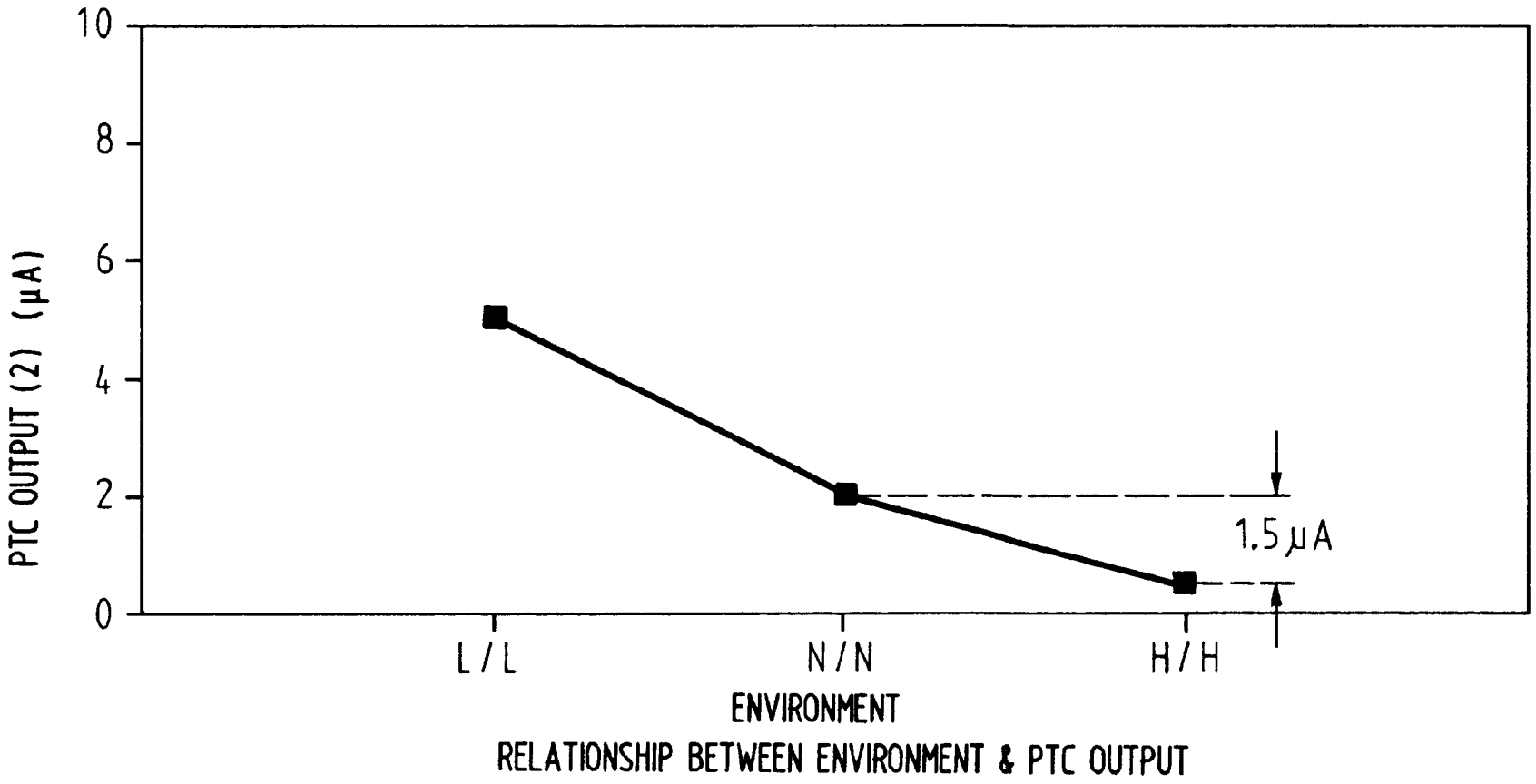
FIG. 6 is a graph showing the output values of the pre-transfer charger controlled according to environment.

By this control it becomes possible to eliminate a difference with a normal temperature environment and generation of transfer voids and image memory on the photosensitive drum can be prevented. Further, in FIG. 6, N/N, L/L and H/H indicates the normal temperature environment, the low temperature and low humid environment and the high temperature and high humid environment, respectively.

Figure 7:
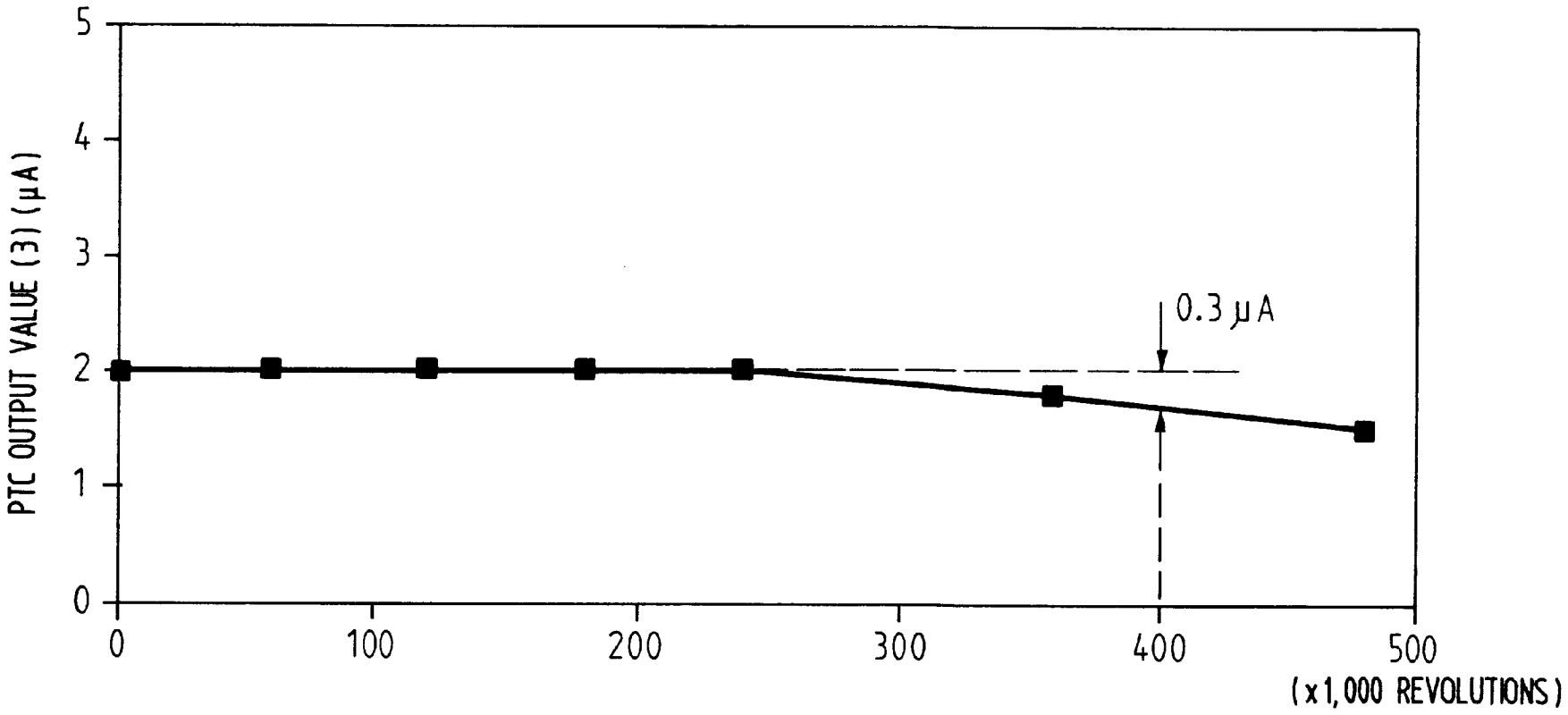
FIG. 7 is a graph showing the relationship between the life (the number of rotations) of the photosensitive drum and the output values of the pre-transfer charger.

Further, the CPU 62 controls the discharge output of the pre-transfer charger 104 to lower it according to the usage history of the photosensitive drum 12, in other words, as the photosensitive drum gets near its life. That is, on the photosensitive drum 12, the white ground potential increases due to increase in the permanent residual potential and drop in sensitivity as the photosensitive drum 12 gets near its life and the fog on the drum increases. The CPU 62 controls the discharge output of the pre-transfer charger 104 to gradually decrease after the life of the photosensitive drum reaches a specified value based on the count of usage times of the photosensitive drum made by the life counter 97 as shown in FIG. 7. In this case, for instance, the discharge output is decreased gradually in a range of 0–5 $\mu$A.

Figure 8:
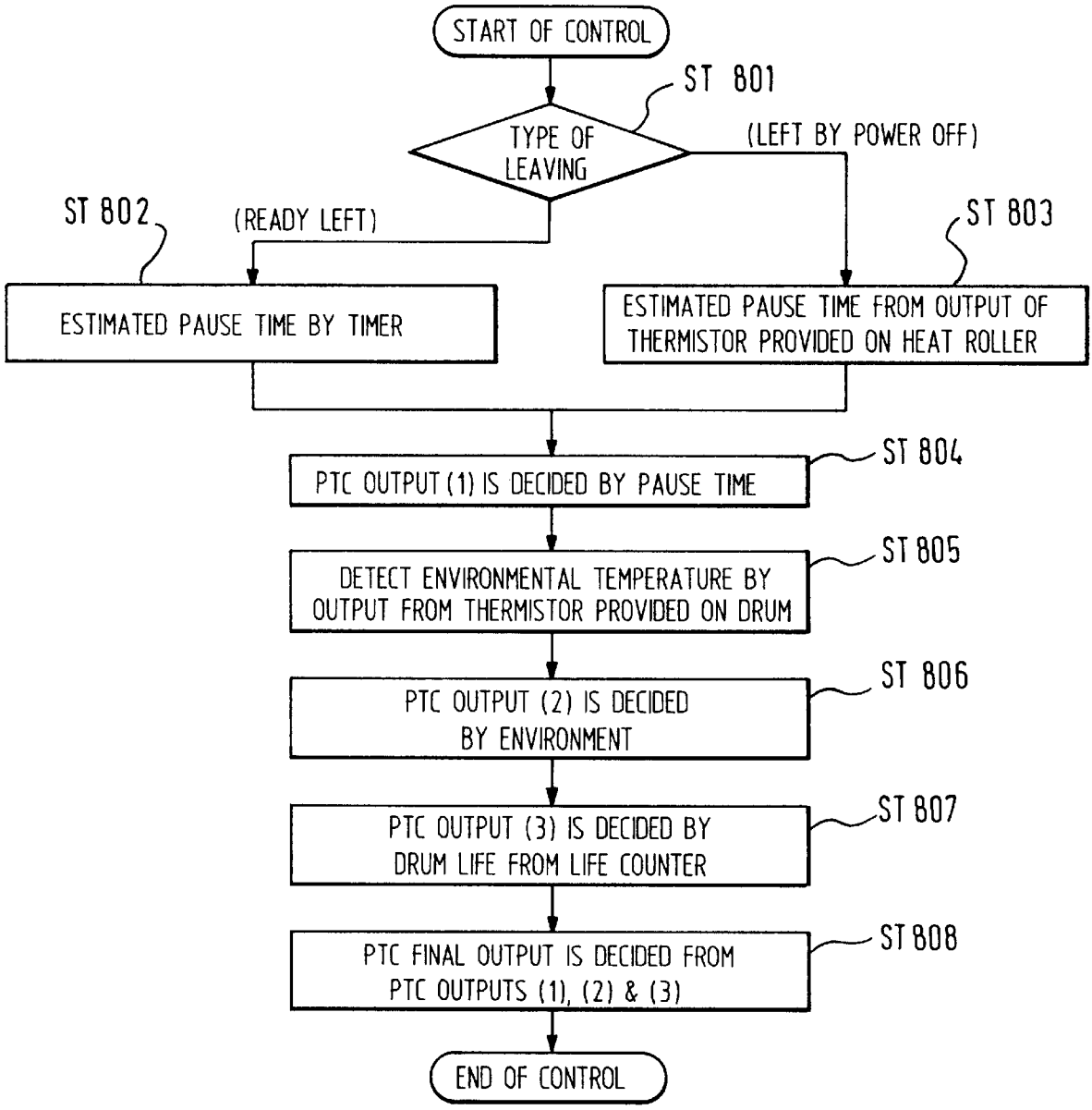
FIG. 8 is a flowchart showing the control operation of discharge output of the charge removing charger in the copying machine shown in FIG. 1.

FIG. 8 shows the definite control operation of the copying machine based on the various test results described above. First, after starting the control, the CPU 62 judges whether the copying machine is left as the power supply is turned OFF or the power supply is kept ON and is in the ready state (STEP 801). Then, a pause time of the copying machine, that is, a time when the cold-cathode tube 102 was left is calculated. For instance, if the paused state is the ready left, a pause time when the cold-cathode tube 102 was left is calculated using the timer 96 of the copying machine (STEP 802).

On the other hand, if the pause state was due to the power OFF of the copying machine, the temperature of the heat roller 40*a* is detected according to the signal from the thermistor 40*c* and from the detected temperature, estimating how long the copying machine was left, a pause time is calculated (STEP 803).

Then, the CPU 62 decides the initial discharge output (1) of the pre-transfer charger 104 based on the calculated pause time and the control data shown in FIG. 5 (STEP 804). For instance, when a pause time is 3 minutes, the line of the initial discharge output 10 $\mu$A is selected as shown in FIG. 5.

Then, the CPU 62 detects a temperature of the photosensitive drum 12 when the power supply of the copying machine is ON according to the signal from the thermistor 66 (STEP 805). From this detected drum temperature, in what environment the copying machine is estimated and the discharge output (2) of the pre-transfer charger 104 is decided based on the control data shown in FIG. 6 (STEP 806). For instance, if the environment wherein the copying machine is placed is the H/H environment, that is, the high temperature/high humid environment, the discharge output of the pre-transfer charger 104 in the N/N environment, that is, the normal temperature/normal humidity environment must be reduced by 1.5 $\mu$A.

Further, the CPU 62 decides the discharge output (3) (STEP 807) of the pre-transfer charger 104 based on the count value of the life counter 97 and the control data shown in FIG. 7. For instance, if the life of the photosensitive drum 12 is 400,000 (that is, the number of rotations of the photosensitive drum is 400,000 times), the discharge output of the pre-transfer charger 104 must be reduced by 0.3 $\mu$A as shown in FIG. 7.

Then, based on the decided discharge outputs (1), (2) and (3) (STEP 808), the final discharge output value of the pre-transfer charger 104 is calculated. That is, $(-1.5)+(-0.3)=-1.8$ $\mu$A. The discharge output of the pre-transfer charger 104 from start of the operation of the copying machine will be a value reduced from the pause time 3 minutes line shown in FIG. 5 by 1.8 $\mu$A.

When the copying operation is started, the CPU 62 applies the charge removing light from the cold-cathode tube 102 and has the pre-transfer charger 104 start the discharge at the initial discharge output (1). Then, when the copying is carried out continuously, the discharge output of the pre-transfer charger 104 is gradually reduced according to the continuous copying time detected by the timer 96 of the copying machine and the discharge output is maintained at the calculated final discharge output value.

Figure 9:
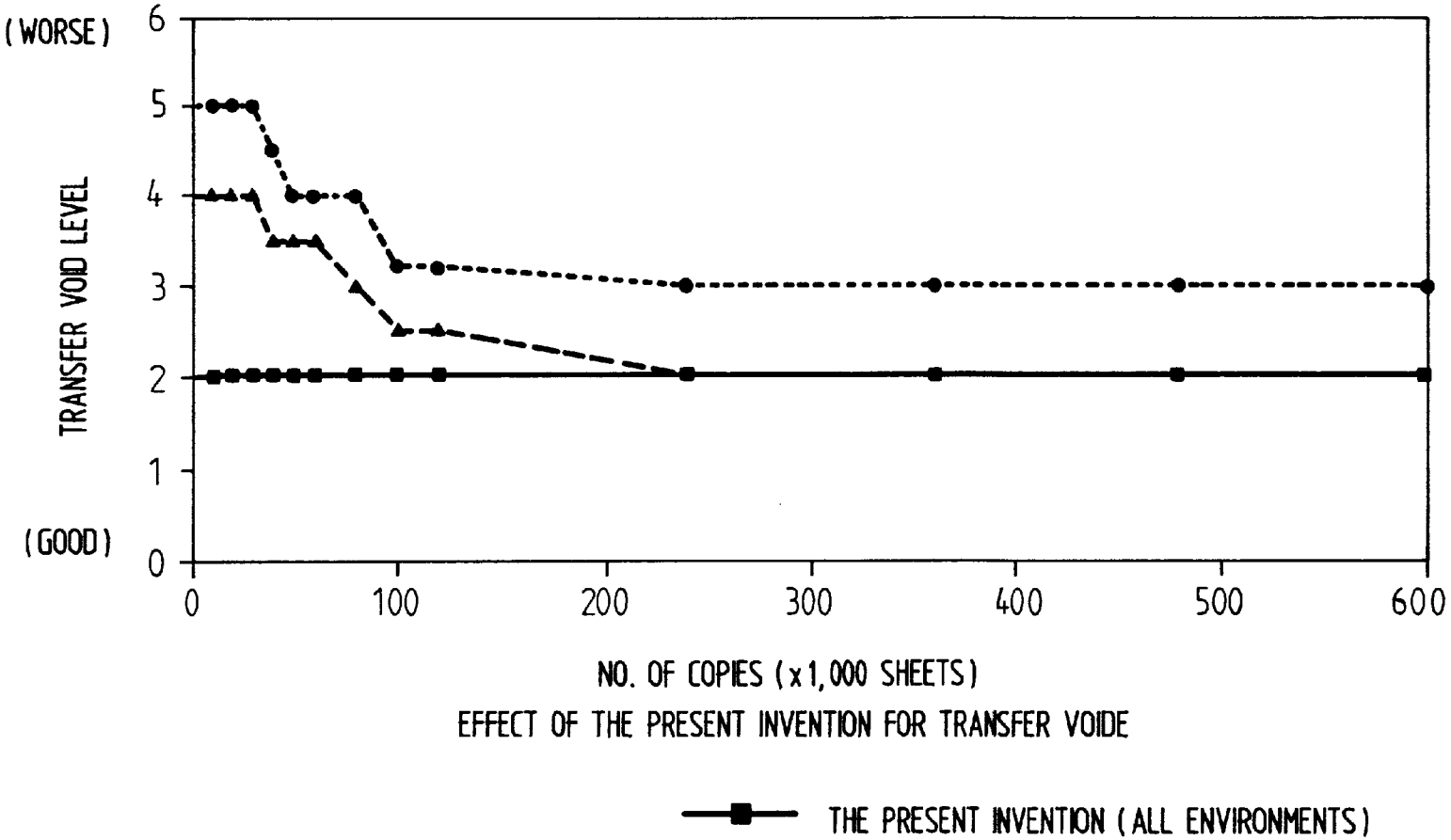
FIG. 9 is a graph showing the transfer void level when the discharge output of the charge removing charger is controlled.
Figure 10:
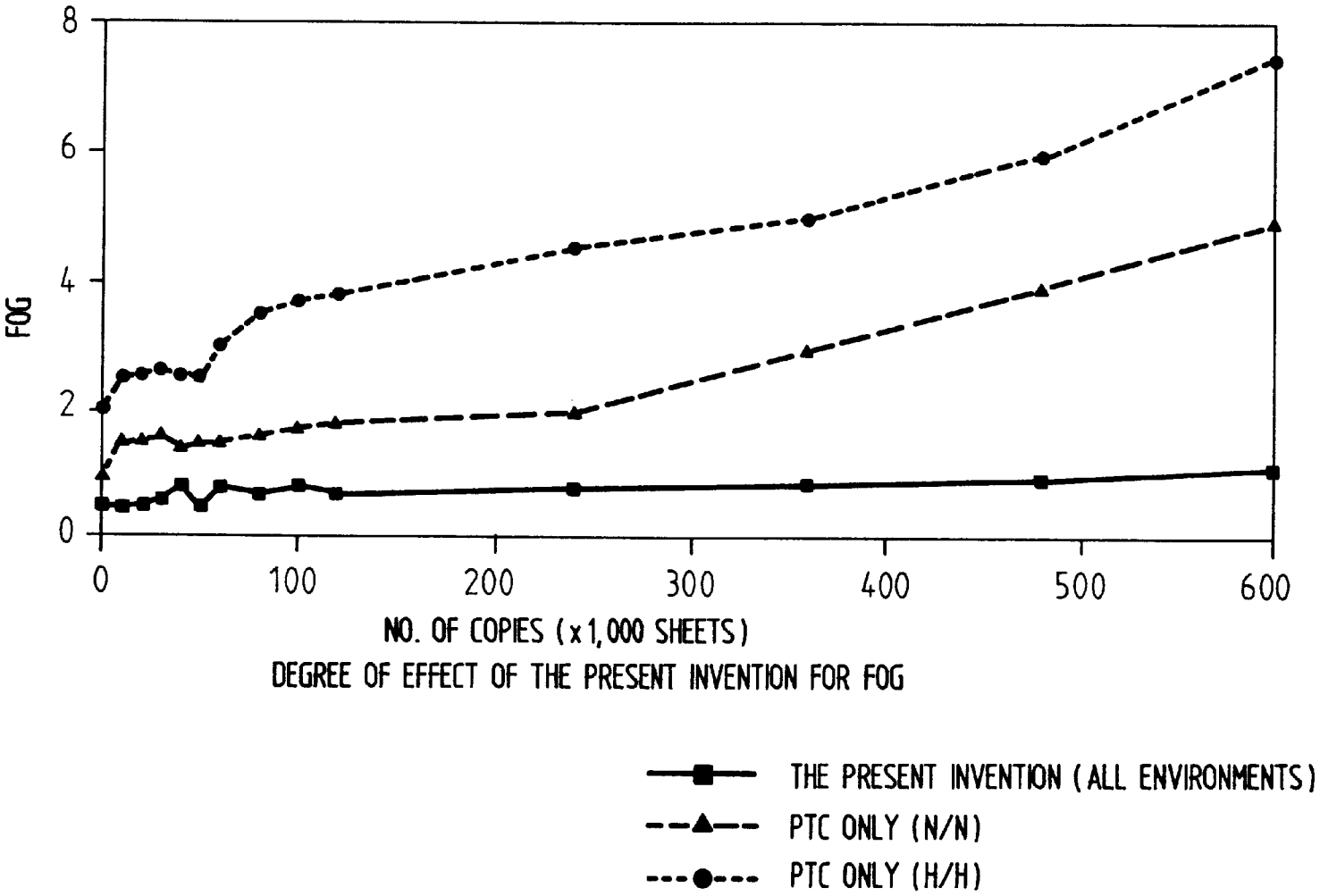
FIG. 10 is a graph showing the state of fog when the discharge output of the charge removing charger is controlled.

FIGS. 9 and 10 show the transfer void levels and fog generating state, respectively when the discharge output of the pre-transfer charger 104 in the pre-transfer charge eliminator 100 was controlled as described above.

As can be seen in FIG. 9, by changing the discharge output of the pre-transfer charger 104 according to changes in the quantity of light of the cold-cathode tube 102 and environmental temperature, the charge removing capacity of the pre-transfer charge eliminator 100 is adjusted to a specified value. By this adjustment, it becomes possible to maintain the transfer void level at a level involving no problem and improve the transfer efficiency either at the initial stage when the cold-cathode tube 102 is turned ON and in the continuous copying operation.

Further, as can be seen in FIG. 10, by changing the discharge output of the pre-transfer charger 104 according to the change in the environmental temperature and the usage history of the photosensitive drum 12, the charge removing capacity of the pre-transfer charge eliminator 100 is adjusted to a specified value. By this adjustment, it becomes possible to reduce image fogs and form high-grade images even under a high temperature and humid environment and when the photosensitive drum 12 is in the state close to its life.

Further, the present invention is not restricted to the embodiment described above but various modifications may be made within the range of the present invention. For instance, the cold-cathode tube is used as the charge removing light source in the embodiment but not limited to it and an LED array and other light sources are usable. For instance, when an LED array is used, by adjusting the discharge output of the pre-transfer charger according to the change in the environment and the usage history of the photosensitive drum, it becomes possible to form a high-grade image by reducing image fog even under a high temperature and highly humid environment and in the state of the photosensitive drum which is close to its life likewise the embodiment described above.

Further, when either a DC charger or an AC charger is used for the pre-transfer charger of the pre-transfer charge eliminator 100, the same action and effect can be obtained.

Further, not limiting to analog type copying machines, the present invention may be applied to digital copying machines, laser printers and other image forming apparatus. Further, a photosensitive drum is also not limited to such organic system as OPC drum, etc. described above, even when an inorganic photosensitive drum is used, similar action and effect can be obtained.

As described above in detail, the discharge output of the charge removing charger is adjusted using a charge removing light source and a charge removing charger jointly as a pre-transfer charge removing means. By this adjustment, it becomes possible to maintain the charge removing capacity of the pre-transfer charge removing means at a specified level and provide an image forming apparatus capable of good images without causing defective images such as transfer void, image memory, fog, etc.

What is claimed is:

1. An image-forming apparatus comprising:

means for electrically charging an image carrier uniformly;

means for forming an electrostatic latent image on the charged image carrier;

means for developing the electrostatic latent image on the image carrier to form a developer image using an electrostatic adsorbing power generated between a developer and the image carrier;

means for transferring the developer image from the image carrier onto an image-receiving medium; and means for removing the electric charge on the image carrier before transferring the developer image to reduce the electrostatic adsorbing power, the charge removing means including:

a cold-cathode tube for applying a light to the image carrier and the developer image to reduce the electric charge;

a charge-removing charger for discharging the image carrier to apply a discharge output to the image carrier to remove the electric charge from the image carrier, the discharge output of the charge-removing carrier being controllable; and means for controlling the discharge output of the charge-removing charger according to change in the quantity of light of the cold-cathode tube to maintain the charge-removing capacity of the charge-removing charger at a specified value.

2. An image forming apparatus claimed in claim 1, wherein the charge removing capacity of the charge removing means is constant.

3. An image forming apparatus claimed in claim 1, further comprising means for measuring a pause time of the image forming apparatus, wherein the controlling means controls the discharge output of the charge removing charger based on the pause time measured by the measuring means.

4. An image forming apparatus claimed in claim 1, further comprising means for detecting a use environment of the image forming apparatus, wherein the controlling means controls the discharge output of the charge removing charger according to the use environment detected by the environment detecting means.

5. An image forming apparatus claimed in claim 1, further comprising means for detecting a usage history of the image carrier, wherein the controlling means controls the discharge output of the charge removing charger based on the usage history detected by the usage history detecting means.

6. An image forming apparatus claimed in claim 1, further comprising:

means for measuring a pause time of the image forming apparatus; and means for detecting a lighting time of the cold-cathode tube;

wherein the controlling means sets up an initial discharge output of the charge removing charger according to the pause time of the image forming apparatus measured by the measuring means, and reduces the discharge output of the charge removing charger from the initial discharge output according to the increase in the lighting time of the cold-cathode tube detected by the detecting means, so that the charge removing means is maintained at a specified charge removing capacity.

7. An image forming apparatus claimed in claim 6, further comprising:

temperature detecting means for detecting a temperature environment of the image forming apparatus; and history detecting means for detecting a usage history of the image carrier;

wherein the controlling means maintains the discharge output of the charge removing charger at a higher discharge output than that at a normal temperature environment when a low temperature environment is detected by the temperature detecting means, maintains the discharge output of the charge removing charger at a lower discharge output than that at a normal temperature environment when a high temperature environment is detected by the temperature detecting means, and controls the discharge output of the charge removing charger to reduce it as the image carrier gets close to its life according to the detected result of the history detecting means.

8. An image forming apparatus claimed in claim 6, further comprising:

temperature detecting means for detecting a temperature environment of the image forming apparatus;

wherein the controlling means maintains the discharge output of the charge removing charger at a higher discharge output than that at a normal temperature environment when a low temperature environment is detected by the temperature detecting means, and maintains the discharge output of the charge removing charger at a lower discharge output than that at a normal temperature environment when a high temperature environment is detected by the temperature detecting means, to control the charge removing means to maintain it at a specified charge removing capacity.

9. An image forming apparatus claimed in claim 6, further comprising:

history detecting means for detecting a usage history of the image carrier;

wherein the controlling means controls the discharge output of the charge removing charger to reduce it as the image carrier gets close to its life according to the detected result of the history detecting means.

10. An image-forming apparatus comprising:

means for electrically charging an image carrier uniformly;

means for forming an electrostatic latent image on the charged image carrier;

means for developing the electrostatic latent image on the image carrier to form a developer image using an electrostatic adsorbing power generated between a developer and the image carrier;

means for transferring the developer image from the image carrier onto an image-receiving medium; and means for removing the electric charge on the image carrier before transferring the developer image to reduce the electrostatic adsorbing power, the charge-removing means including:

a cold-cathode tube for applying a light to the image carrier and the developer image to reduce the adsorbing power;

a charge-removing charger for discharging the image carrier to apply a discharge output to the image carrier to remove the electric charge from the image carrier, the discharge output of the charge-removing charger being controllable; and means for controlling the discharge output from the charge-removing charger according to change in the quantity of light of the cold-cathode tube to maintain a charge-removing capacity of the charge-removing charger at a specified value.

11. An image forming apparatus claimed in claim 10, further comprising:

means for detecting a pause time of the image carrier;

wherein the controlling means sets up an initial discharge output of the charge removing charger according to the pause time of the image carrier detected by the pause time detecting means and controls the discharge output of the charge removing charger according to change in the quantity of light of the cold-cathode tube to maintain the charge removing capacity of the charge removing means at a specified value.

12. An image-forming apparatus comprising:

means for electrically charging an image carrier uniformly;

means for forming an electrostatic latent image on the charged image carrier;

means for developing the electrostatic latent image on the image carrier to form a developer image using an electrostatic adsorbing power generated between a developer and the image carrier;

means for transferring the developer image from the image carrier onto an image-receiving medium;

means for removing the electric charge on the image carrier before transferring the developer image to reduce the electrostatic adsorbing power; and means for detecting a usage history of the image carrier, the charge-removing means including:

a light source for applying a light to the image carrier and the developer image to reduce the electric charge;

a charge-removing charger for discharging the image carrier to apply a discharge output to the image carrier to remove the electric charge from the image carrier, the discharge output of the charge-removing charger being controllable; and means for controlling the discharge output from the charge-removing charger according to the usage history of the image carrier detected by the usage history detecting means to adjust a charge-removing capacity of the charge-removing means.

* * * * *